United States Patent [19]

Geremia

[11] Patent Number: 4,799,426

[45] Date of Patent: Jan. 24, 1989

[54] SYSTEM AND METHOD FOR MOVING SKIPS AND PRESSING SCRAP IN A SKIP

[75] Inventor: Nonini Geremia, Buttrio, Italy

[73] Assignee: Danieli & C. Officine Meccaniche SpA, Buttrio, Italy

[21] Appl. No.: 82,319

[22] Filed: Aug. 6, 1987

[51] Int. Cl.[4] ..... B30B 15/32; B30B 9/32

[52] U.S. Cl. ..... 100/218; 100/100; 100/214; 100/229 R; 100/295; 100/35; 294/68.27; 414/626; 75/44 S

[58] Field of Search ..... 266/901; 75/44 S; 280/35, 638; 414/626, 561, 461; 294/68.27; 100/224, 218, 918, 229 R, 295, 196, 214, 100

[56] References Cited

U.S. PATENT DOCUMENTS 3,416,436 12/1968 Tezuka .
3,476,372 11/1969 Tezuka ..... 266/901 X
3,665,848 5/1972 Kimura et al. ..... 100/229 R X
3,887,082 6/1975 Posselt ..... 414/629
4,470,580 9/1984 Vezzani .

FOREIGN PATENT DOCUMENTS 0035568 9/1981 European Pat. Off. .
479798 12/1953 Italy ..... 100/229 R

*Primary Examiner*—Andrew M. Falik
*Attorney, Agent, or Firm*—Wegner & Bretschneider

[57] ABSTRACT

A system for the pressing of scrap in skips which charge furnaces in steel works, whereby a skip (12) is borne on a support with legs (15) by means of a vehicle with a vertically moveable platform (16) and is then rested on a press cradle (17), the press (11) comprising hooks for engaging with support pins (13) included on the skip (12) so as to support the skip itself (12) momentarily below the press (11).

8 Claims, 3 Drawing Sheets

SYSTEM AND METHOD FOR MOVING SKIPS AND PRESSING SCRAP IN A SKIP

BACKGROUND OF THE INVENTION

This invention concerns improvements to presses for the pressing of scrap in skips used to charge furnaces for steelworks.

The invention concerns also the presses which employ such improvements for the pressing of scrap in skips.

The invention refers also to a method to move skips below the presses.

At the present time the skips employed to charge scrap into furnaces for steelworks are moved by means of appropriate supports having legs and a substantially square floor plan or another shape.

Such supports with legs make possible the use of vehicles which comprise a raisable platform and, being introduced below the supports themselves, lift the supports and convey them wherever required.

The pressing of scrap in skips to improve the filling of the latter and to reduce the time employed in charging the furnace is a common practice nowadays.

Such pressing is carried out with appropriate presses, the skips being rested on suitable cradles which accommodate and support them.

At the present time the skips are rested on their own supports with legs and are then conveyed to the press zone, where a crane lifts them from their support and places them on a cradle.

The cradle is then moved under the press for the pressing operation and, when the pressing has been performed, is brought back to the neighbourhood of the support with legs, onto which the skip is reloaded.

This known system requires a high capacity crane with heavy investment costs and high movement and running costs. It also entails considerable space and downtimes.

U.S. Pat. No. 4,470,580 discloses a press for scrap in which the die consists of two elements of different diameters, the outer element being fitted when required.

U.S. Pat. No. 3,416,436 discloses a press for scrap which cooperates with a skip having a vertically movable bottom to discharge the scrap when pressed.

EP Patent No. 0.035.568 discloses a press for briquettes in which the press mould can be moved on an appropriate truck and can be positioned vertically by plungers included in the structure of the press so as to discharge the briquettes.

The present applicant has therefore designed and embodied the invention according to this application.

SUMMARY OF THE INVENTION

According to the invention the skip with its relative support with legs is brought by a vehicle with a raisable platform directly below the press.

When the skip is below the press, appropriate hooks are secured to anchorage pins comprised on the skip.

As soon as the skip is aligned with the hooks and is substantially on the same axis as the ram of the press, the vehicle lowers its platform and thus lowers the skip, which thus is hung on the hooks.

The hooks themselves may also be moved vertically.

When the platform of the vehicle is lowered, the support with legs is thus released from the skip without having touched the ground with its legs and thus can be removed by the vehicle itself.

When the support with legs has been removed, the cradle is introduced below the skip so that, when the hooks are lowered, the skip itself is upheld by the cradle, the hooks are freed and removed and the pressing operation can take place.

When the pressing operation has taken place, the cycle is repeated in the reverse order and the skip is removed by the vehicle with the movable platform.

The invention is therefore obtained with improvements to presses for the pressing of scrap in skips which charge furnaces in steelworks, whereby a skip is borne on a support with legs by means of a vehicle with a vertically movable platform and is then rested on a press cradle, the improvements being characterized in that the press comprises hooks suitable to cooperate momentarily with support pins included on the skip so as to support the skip itself momentarily below the press.

The invention is also embodied with presses which adopt such improvements to press scrap in skips.

The invention is also obtained with a method whereby the skip is supported momentarily by hooks for the withdrawal or introduction of a support with legs and for the introduction or withdrawal of a cradle.

BRIEF DESCRIPTION OF THE DRAWINGS

The figures, which are given as a non-restrictive example, show the following.

In the figures the same parts or parts having the same functions bear the same reference numbers.

DETAILED DESCRIPTION OF THE PREFERRED EMBODIMENT

Figure 1:
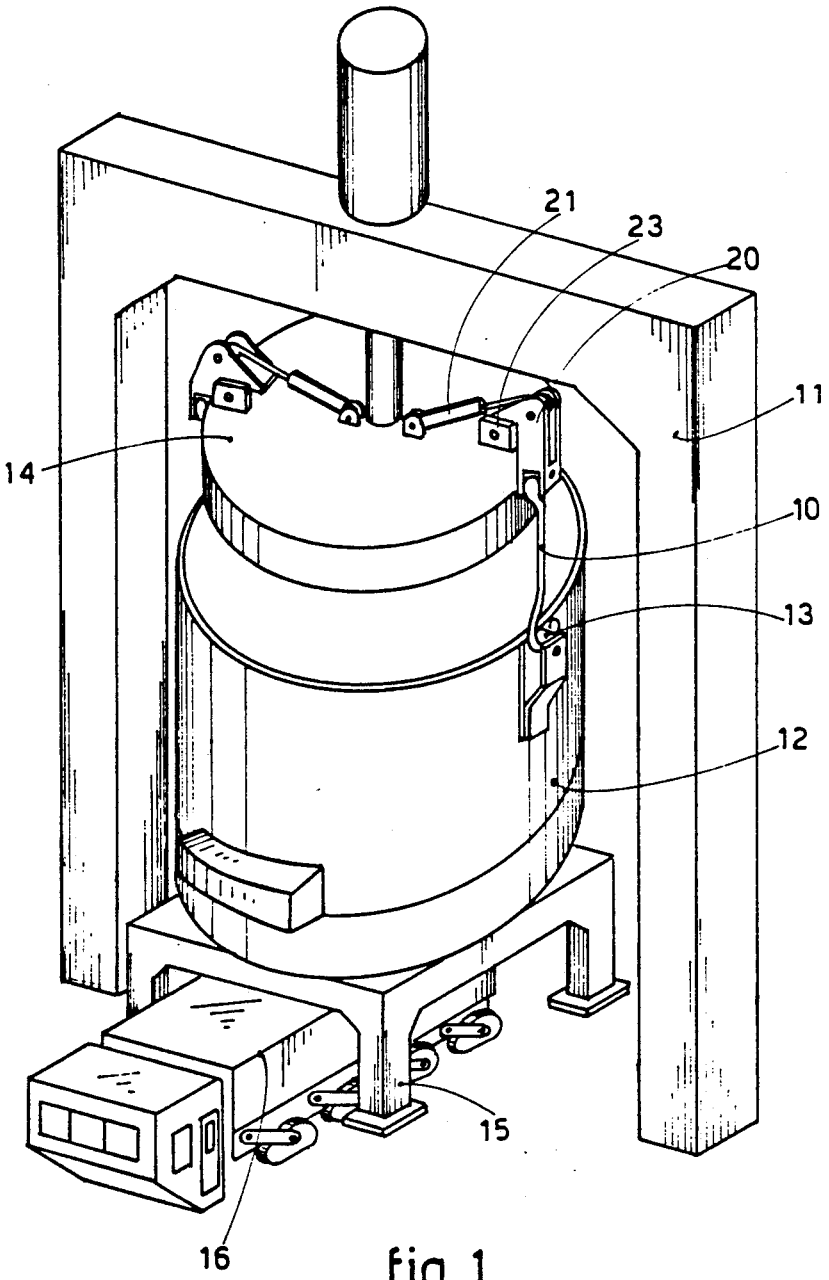
FIG. 1 gives a three-dimensional front perspective view of a system according to the invention an improved press.

A vehicle 16 having a vertically movable platform and bearing a support with legs 15 on which is positioned a skip 12 filled with scrap, places such skip 12 under the portal of a press 11.

Hooks 10 are caused to cooperate with support pins 13 comprised on the skip 12 so that, when the hooks 10 are raised or the skip 12 is lowered slightly, the hooks 10 support the skip 12 by securing themselves to the support pins 13. Such pins 13 may be located at the side of or at the top of the skip 12.

When the skip 12 is secured to the hooks 10 by means of the support pins 13, the platform of the vehicle 16 is lowered until the support with legs 15 is disengaged from the skip 12.

When the support with legs 15 has been disengaged from the skip 12, the vehicle with the movable platform 16 moves the support with legs 15, and a cradle 17 is introduced instead of such support and, being empty, can be moved easily. When the cradle 17 has been introduced, the skip 12 is lowered until it rests on the cradle 17.

When the skip 12 is supported on the cradle 17, the hooks 10 are freed and removed by devices 19 which move such hooks.

Figure 2:
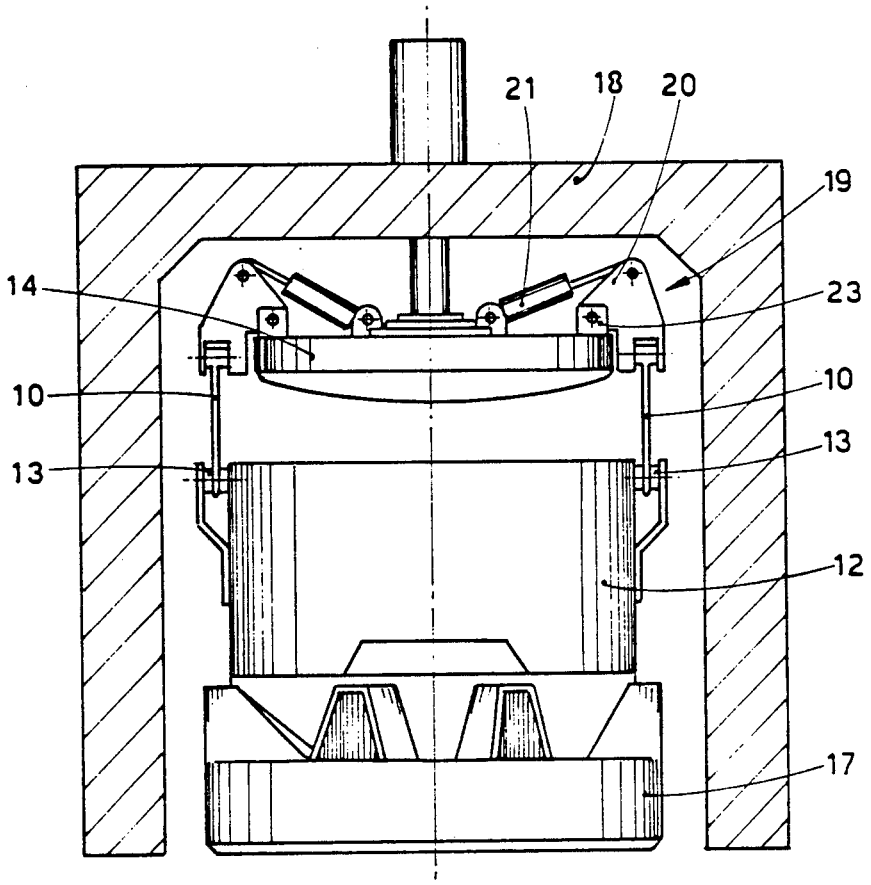
FIG. 2 gives a front elevational view of the press of FIG. 1.
Figure 3:
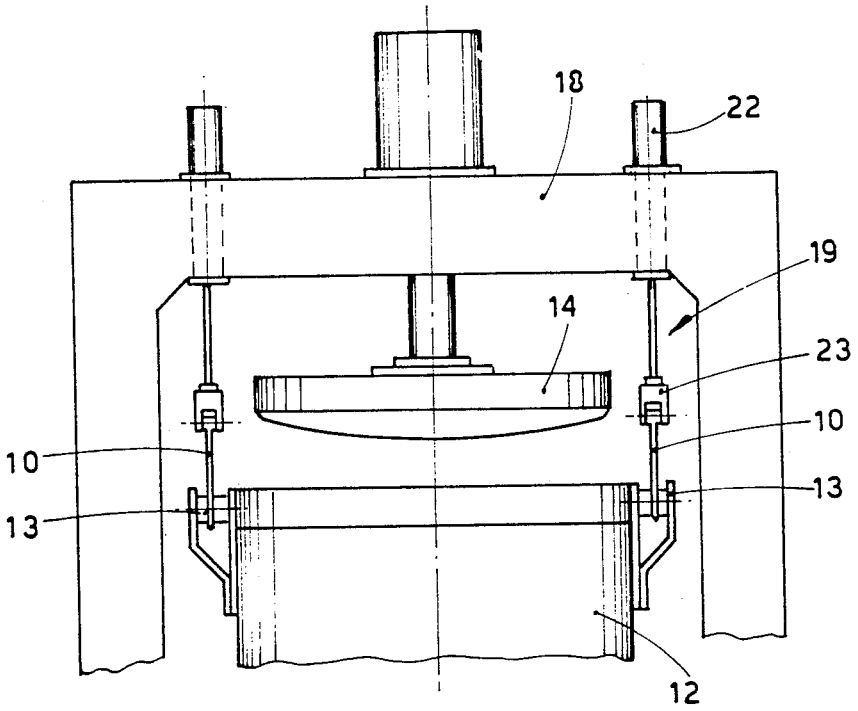
FIG. 3 gives a front elevational view of a further embodiment of the press.
Figure 4:
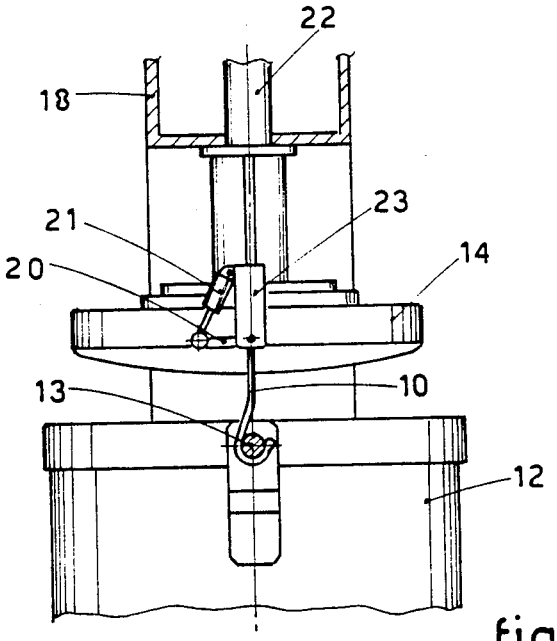
FIG. 4 gives a side elevational view of another embodiment of the press.

Such devices 19 to move the hooks may be fitted to the plate of the ram of the press (FIGS. 1 and 2) or to the cross member 18 of the press 11 (FIGS. 3 and 4). These devices 19 may also be fitted to the upright side members of the press.

In either case lifting jacks 22 may be provided.

The devices 19 to move the hooks in the example shown comprise a lever support 23, levers 20 to rotate the hooks 10 and jacks 21 to withdraw the hooks from the working zone.

In the example of FIGS. 3 and 4 the lever supports 23 are secured to a jack 22, whereas in the example of FIGS. 1 and 2 the lever support 23 is anchored to the plate 14 of the ram and the ram itself of the press acts as a jack 22 if so required.

I claim:

1. A system for pressing scrap in a skip, comprising a skip for holding scrap to be pressed, comprising support pins;

a support with legs for supporting the skip;

a press for pressing scrap within the skip, said press comprising hooks for engaging the support pins of the skip to support the skip;

a vehicle comprising a vertically moveable platform, for transporting the support with legs and skip to and away from the press; and a cradle for supporting the skip during pressing of scrap, wherein the support with legs is replaced by the cradle when the skip is supported by said hooks.

2. A system as claimed in claim 1, wherein the press further comprises means for displacing the hooks.

3. A system as claimed in claim 12, wherein the press for pressing scrap comprises:

a frame;

a ram having a plate supported by the frame for pressing scrap;

hooks for supporting the skip beneath the ram; and means for displacing the hooks, said means for displacing being anchored to the plate of the ram.

4. A system as claimed in claim 1, wherein the press for pressing scrap in a skip comprises:

a frame having upright side members;

a ram supported by the frame for pressing scrap;

hooks for supporting a skip beneath the ram; and means for displacing the hooks, said means for displacing being anchored to the upright side members of the frame.

5. A system as claimed in claim 1, wherein the press for pressing scrap in a skip comprises:

a frame;

a ram supported by the frame for pressing scrap;

hooks for supporting a skip beneath the ram; and means for displacing the hooks, said means for displacing comprising lifting jacks.

6. A method for pressing scrapin a skip, comprising:

providing a skip containing scrap to be pressed, said skip comprising support pins and being supported on a support with legs;

transporting the support with legs and skip to a press comprising hooks for engaging the support pins, by means of a vehicle having a vertically moveable platform;

supporting the skip by engaging the hooks with the support pins and then removing the support with legs;

positioning a cradle beneath the skip; and pressing the scrap in the skip while the skip is supported by the cradle.

7. A method as claimed in claim 6, further comprising displacing the hooks after the positioning of the cradle beneath the skip.

8. A method as claimed in claim 7, in which the hooks are displaced upwards.

* * * * *